US005546759A

United States Patent [19]

Lee

[11] Patent Number: 5,546,759

[45] Date of Patent: Aug. 20, 1996

[54] REFRIGERATOR HAVING A VEGETABLE COMPARTMENT AND A SEPARATE KIMCHI CHAMBER

[75] Inventor: Sun G. Lee, Suwon, Rep. of Korea

[73] Assignee: Samsung Electronics Co., Ltd., Suwon, Rep. of Korea

[21] Appl. No.: 365,957

[22] Filed: Dec. 29, 1994

[30] Foreign Application Priority Data

Jan. 26, 1994 [KR] Rep. of Korea ..... 94-1465 U

[51] Int. Cl.[6] ..... F25B 29/00

[52] U.S. Cl. ..... 62/441; 62/414; 62/331

[58] Field of Search ..... 62/441, 331, 414, 62/407, 408, 97, 89, 404

[56] References Cited

U.S. PATENT DOCUMENTS

| | | | |
|---|---|---|---|
| 3,077,749 | 2/1963 | Jung et al. | 62/441 |
| 4,662,186 | 5/1987 | Park | 62/408 |
| 5,388,427 | 2/1995 | Lee | 62/331 |
| 5,392,615 | 2/1995 | Lim | 62/414 |
| 5,398,599 | 3/1995 | Woo | 99/468 |
| 5,411,328 | 5/1995 | You | 312/405 |

*Primary Examiner*—Henry A. Bennett
*Assistant Examiner*—William C. Doerrler
*Attorney, Agent, or Firm*—Burns, Doane, Swecker & Mathis, L.L.P.

[57] ABSTRACT

A refrigerator includes a refrigerating compartment disposed above a freezing compartment, with a horizontal divider wall disposed therebetween. A vegetable compartment is disposed below the freezing compartment. A kimchi chamber having its own heater rests on the divider wall. An air flow discharged from the kimchi chamber is combined with an air flow discharged from the refrigerating compartment, and those combined air flows are directed to the vegetable compartment. That combining of air flows occurs within the divider wall.

6 Claims, 5 Drawing Sheets

REFRIGERATOR HAVING A VEGETABLE COMPARTMENT AND A SEPARATE KIMCHI CHAMBER

RELATED INVENTION

This invention is related to an invention disclosed in U.S. Ser. No. 08/366,104, filed concurrently herewith and commonly owned by the assignee of record.

FIELD OF THE INVENTION

The present invention is related to a refrigerator, and more particularly, a refrigerator having refrigerating, freezing, kimchi, and vegetable compartments and an air flow system for circulating cooling air between the compartments.

BACKGROUND OF THE INVENTION

A refrigerator is utilized to store various foodstuffs under either a frozen or a refrigerated condition for extending the freshness of the foodstuffs stored in the compartment. Such a refrigerator consists of either one of two cooling types, one being a direct cooling type, that is, an evaporator in the refrigerating cycle is installed in a foodstuff storage chamber, and a direct heat-exchange is obtained. The other type of cooling is the indirect cooling type, that is, an evaporator is mounted in a passage, which is separated from the foodstuff chamber, and air which is heat-exchanged by the evaporator is directed to the foodstuff storage chamber by means of a fan.

The refrigerator normally consists of freezing and refrigerating compartments, one being located above the other. Furthermore, the refrigerating compartment is provided with a separate chamber, having a different temperature from that of the refrigerating compartment, known as a "vegetable compartment" or a "chilled compartment" which stores meats etc. The foodstuffs can be separately stored in the chamber in accordance with the desired conditions. On the front surface of each of the freezing and refrigerating compartments a door is installed. The doors hinge on one vertical side in order to provide access to the foodstuffs in their respective compartment. For the passage of cool air, a condenser and a fan are installed in the rear wall of the freezing compartment.

The refrigerator gains advantages that result from the increase in the storage volume and the convenience of the door operation. However, problems may occur when various types of fermented foodstuffs, e.g. kimchi, are stored together with other foodstuffs in the same chamber.

Since kimchi is usually made in a voluminous and heavy amount, a large storage chamber is required. Food stored alongside the kimchi container are affected by the kimchi. Particularly, when kimchi is being fermented, it produces a unique odor which remains in the cool air and circulates in the compartment. There is a problem in that the odor often adversely affects other foodstuffs.

To resolve the above defect, a refrigerator having a separate compartment is disclosed in U.S. patent application Ser. No. No. 08/115,046 (1993.). The refrigerator, as shown in FIG. 5, has a freezer compartment 1, a refrigerating compartment 2 located beneath the freezer compartment 1, a kimchi chamber 3 located beneath the refrigerating compartment 2, and a vegetable compartment 4 located beneath the kimchi chamber 3. The kimchi chamber 3 contains its own cooling and heating mechanisms 31,32 which are mounted on the external surfaces of the walls which form the kimchi chamber 3. The kimchi chamber 3 can be used to ferment and then store food such as kimchi.

Since the conventional refrigerator has an isolated kimchi chamber as described above, and separation of compartments, the air of the kimchi chamber can not smoothly circulate. Thus, the air of the kimchi chamber stays in the kimchi chamber for a long time. This makes foodstuffs stored in the kimchi chamber unsanitary and can cause the user some displeasure.

In particular, the air of the closed kimchi chamber is heated to a higher temperature by heat used to ferment the kimchi. Thus, to solve the ventilation problem the kimchi chamber has to employ cool air inflow and discharging openings to promote the circulation of air through the kimchi chamber. In this case, other problems occur due to the transfer of relatively higher temperature air from the kimchi chamber to another other compartment which has a lower temperature. That is, when the kimchi is fermented the temperature of the air of the kimchi chamber rises 30 degrees. In case that the relatively warmer air is introduced to the evaporator directly, and is combined with the relatively lower cool air from the other compartment at the entrance of the evaporator, the evaporator is easily covered over with frost and this causes the cooling efficiency of the evaporator to decrease. Further, if the air from the kimchi chamber flows into another compartment e.g. the vegetable compartment, the vegetables stored in the vegetable compartment can not retain their freshness for a long period of time.

SUMMARY OF THE INVENTION

The present invention provides a refrigerator with an air flow passage that can easily and effectively remedy the above mentioned problems.

The object of the present invention is to provide a refrigerator which an air flow passage that can combine the air from a kimchi chamber with the air from a refrigerating compartment.

Another object of the present invention is to provide a refrigerator with an air flow passage that can combine relatively warm air from a kimchi chamber with relatively cool air from a refrigerating compartment, the combined air being introduced into the vegetable compartment, thereby preserving the freshness of the vegetables for a long period of time.

According to the present invention, the refrigerator comprises a refrigerating compartment; a freezing compartment; an evaporator located in the rear wall of the freezing compartment; a vegetable containing compartment; a kimchi chamber located between the refrigerating compartment and the freezing compartment and having a heater mounted on an external surface of the kimchi chamber; and an air flow passage system that combines a first cool air flow from the kimchi chamber with a second cool air flow from the refrigerating compartment and then directs the air toward the vegetable containing compartment.

Further, the combining of the first cool air with the second cool air occurs in the intermediate partition wall between the kimchi chamber and the freezing compartment.

The air generated from the evaporator is discharged into the kimchi chamber and the refrigerating compartment, respectively. The second cool air flow from the refrigerating compartment flows into the intermediate partition wall. The first air flow having a relatively warmer temperature, after circulating in the kimchi chamber, also flows into the intermediate partition wall. The first air flow is combined, in the intermediate partition wall, with the second air flow which is relatively cooler than the first air flow. Then the combined air flows are directed into the vegetable compartment.

DETAILED DESCRIPTION OF THE PREFERRED EMBODIMENT

Figure 1:
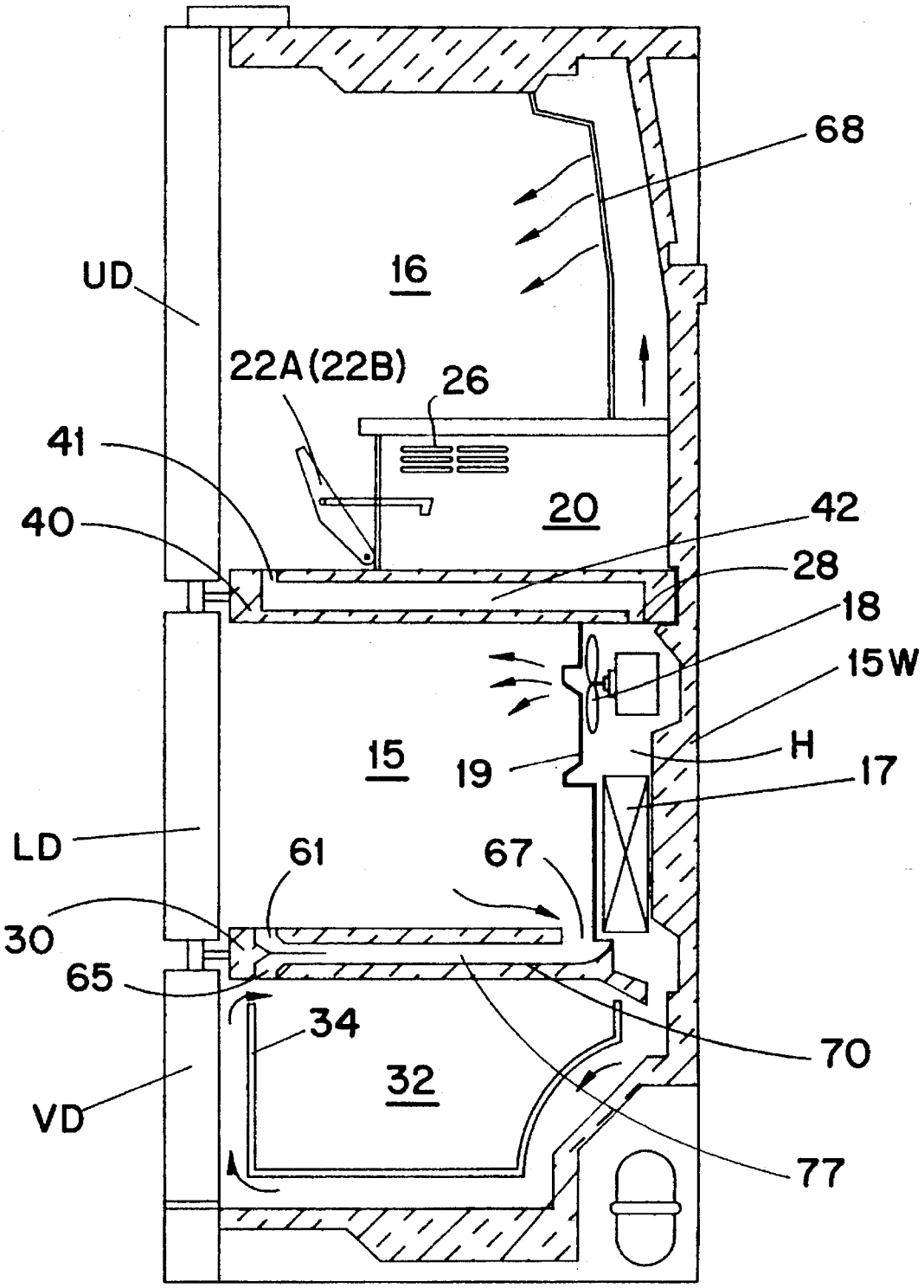
FIG. 1 is a vertical cross-sectional view through a refrigerator according to the present invention, with the section plane oriented perpendicular to front and rear walls thereof.
Figure 2:
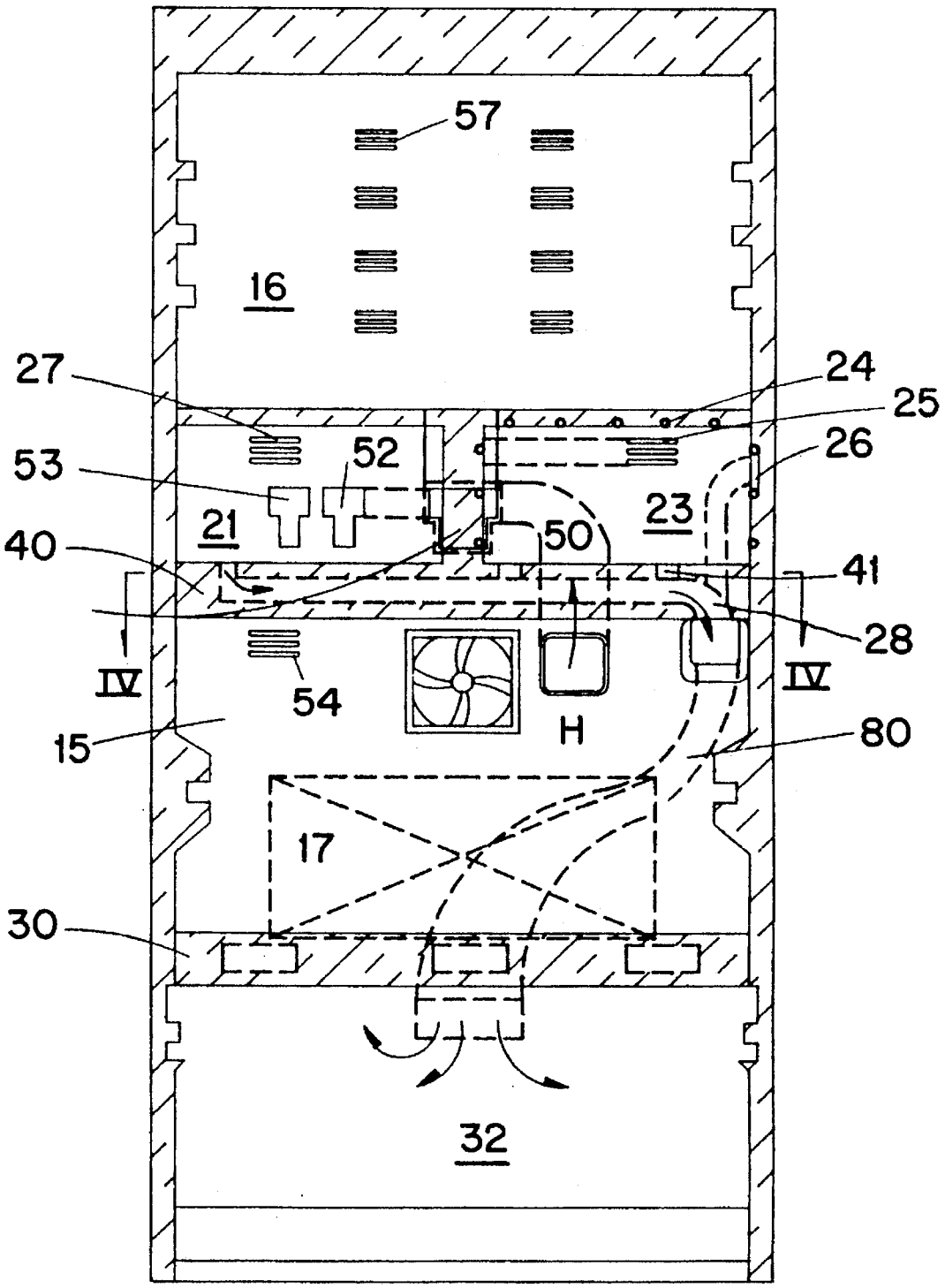
FIG. 2 is a vertical cross sectional view taken through the refrigerator in a plane oriented parallel to the front and rear walls.

In FIGS. 1 and 2, the refrigerator includes a refrigerating compartment 16, an individual compartment 20, a freezing compartment 15, and a vegetable compartment 32 which are all vertically superimposed one upon the other. The refrigerating compartment 16, and the freezing compartment 15 are equipped with doors UD,LD on the front side of the compartments 16,15, respectively. Each door UD,LD is hinged on a vertical axis, presented on the side of each compartment. The individual compartment 20 has doors 22A,22B which are hinged on the lower horizontal corners of the doors 22A,22B. The vegetable compartment 32 has a door VD, at the front of the vegetable compartment 32, which is integrally formed with the vegetable box 34 for sliding the box forward or backward.

Further, a first partition wall 40 is formed between the refrigerating compartment 16 and the freezing compartment 15, and second partition wall 30 is formed between the freezing compartment 15 and the vegetable containing compartment 32.

The individual compartment 20 is covered over by an insulation material that separates the individual compartment 20 from the refrigerating compartment 16. The individual compartment 20 comprises a chilled chamber 21 for allowing the foodstuffs to be stored within a temperature range relative to the individual characteristics of the specific foodstuffs, and a kimchi chamber 23 for fermenting kimchi at a high temperature and storing the fermented kimchi at a low temperature.

At the rear wall 15W of the freezing compartment 15 a heat-exchanging compartment H is provided which has an evaporator 17 and a fan 18. A vertical wall 19 of the compartment H is provided in front of and spaced from the evaporator 17 and the fan 18, and a plurality of discharging openings 54 are formed in the vertical wall 19.

Figure 3:
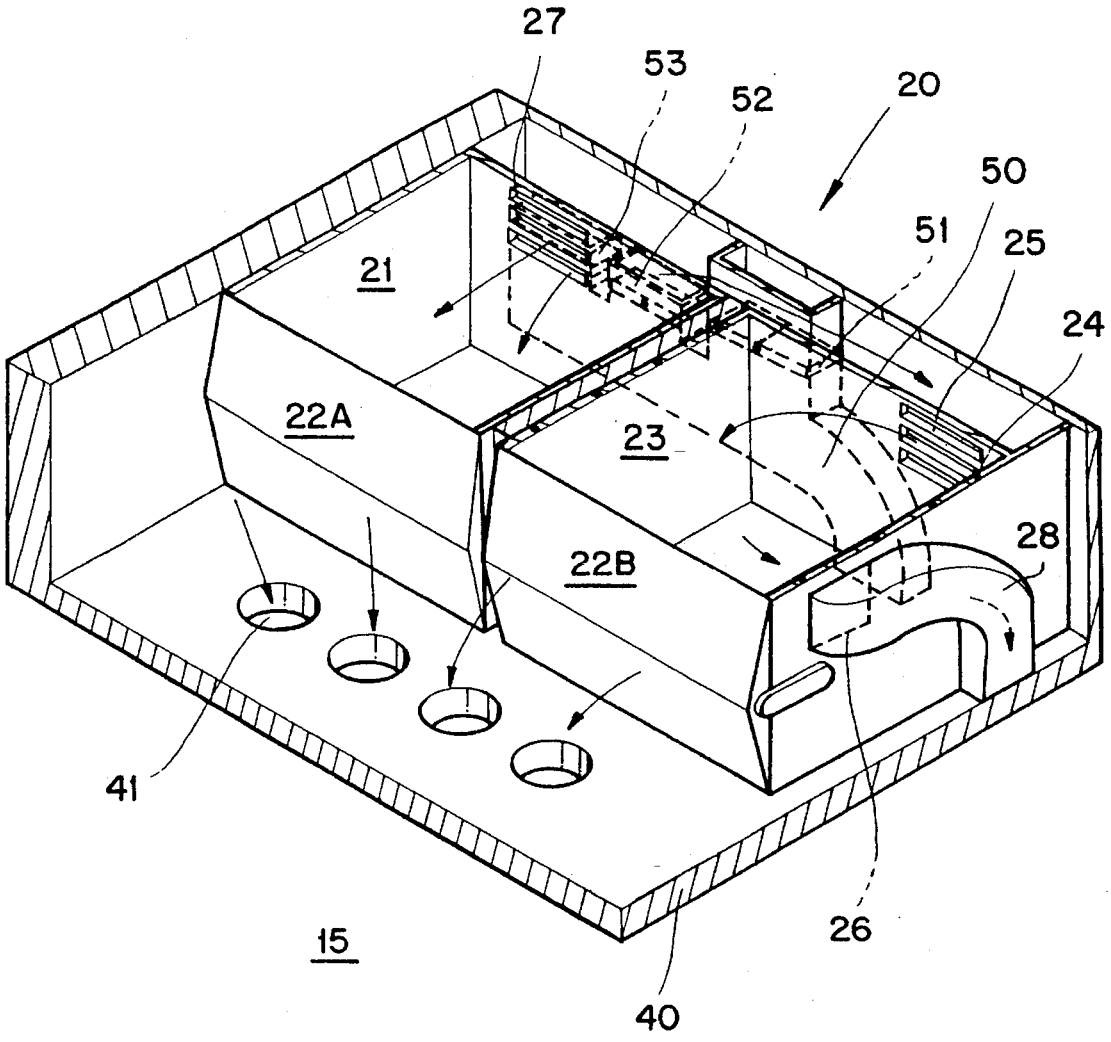
FIG. 3 is a perspective view of an individual compartment having a cool air conducting passage according to the present invention.
Figure 4:
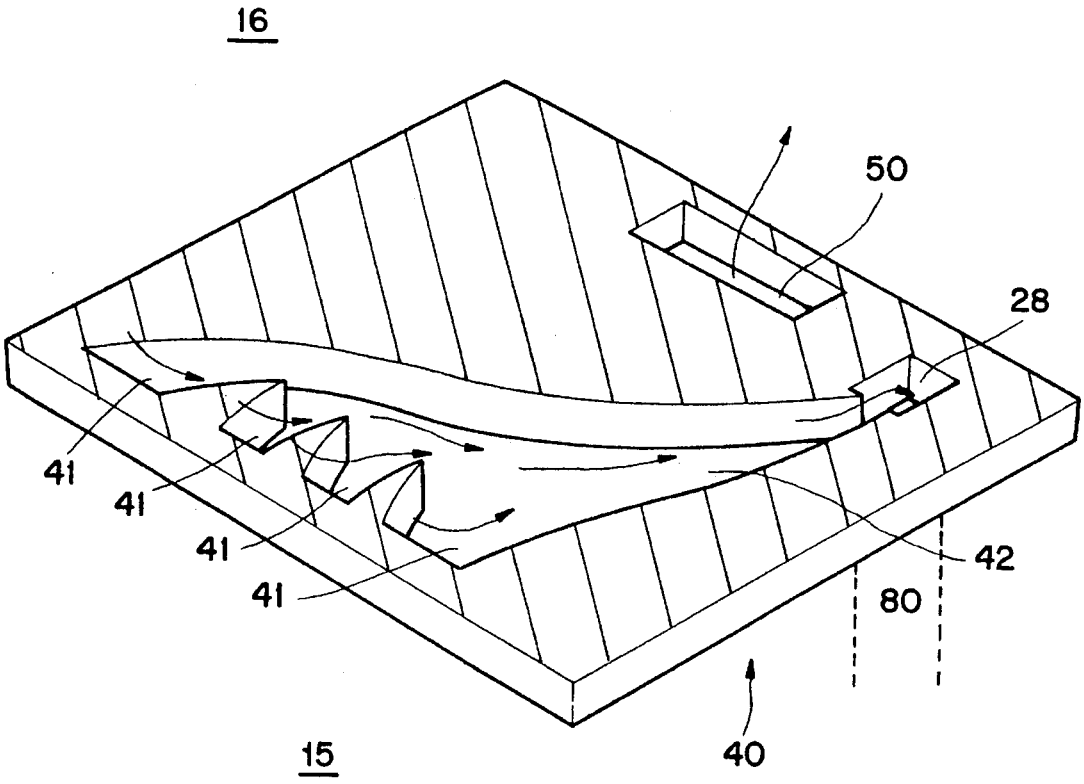
FIG. 4 is a perspective view of a first intermediate partition wall taken along line IV—IV in FIG. 2.
Figure 5:
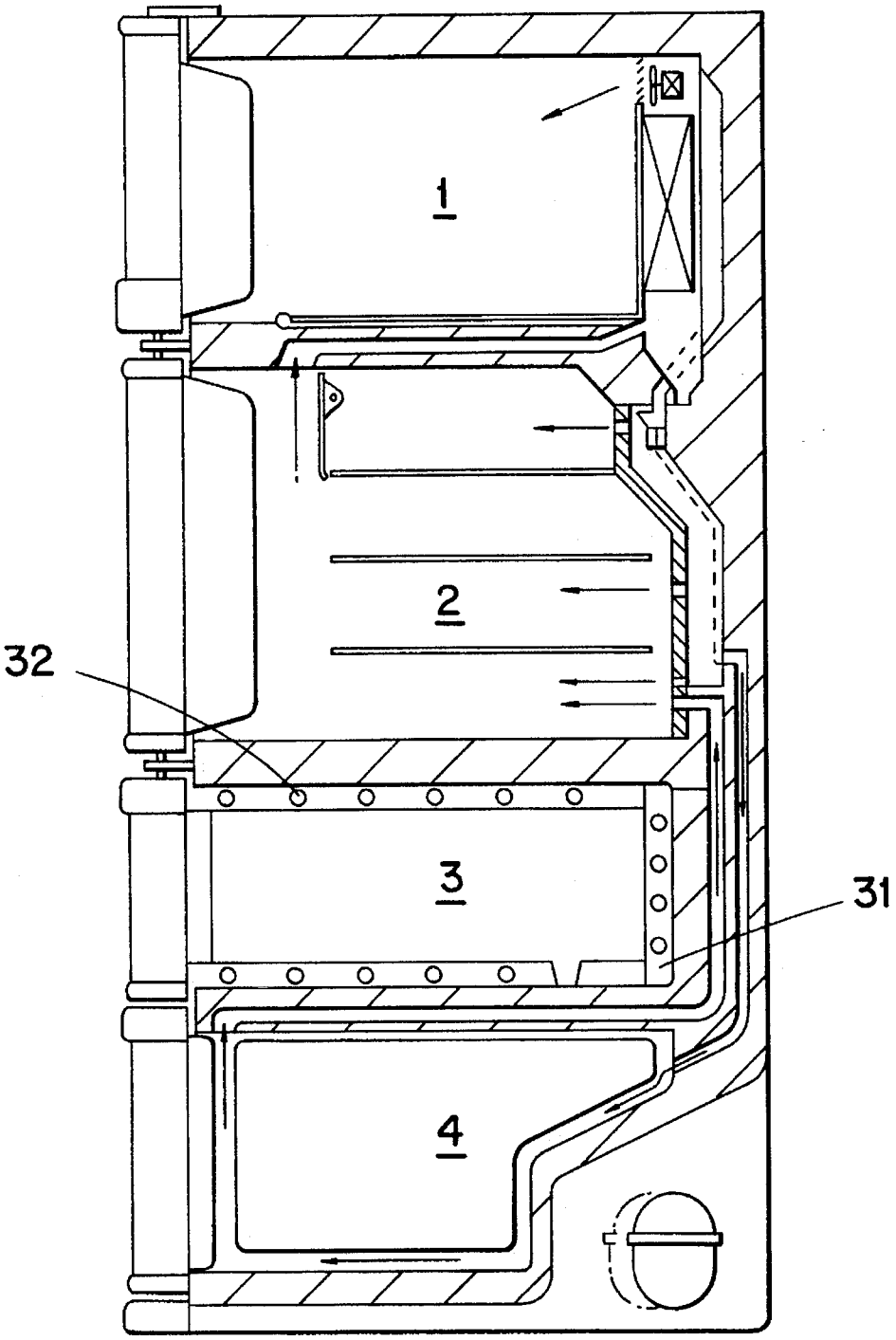
FIG. 5 (PRIOR ART)
FIG. 5 is a view similar to FIG. 1 of a prior art refrigerator.

A main duct 50 extends vertically through the first intermediate partition wall 40 as shown in FIG. 4. Through this duct cool air is induced by the fan 18 into the freezing compartment 15 and every other compartment, that is, the refrigerating compartment 16 and the individual compartment 20 (FIG. 3). In the upper portion of the main duct 50 lower, spaced from the inlet opening, of the main duct 50, a main damper 51 is mounted for controlling the flow of cool air from the heat-exchanging compartment H into the refrigerating compartment 16 and thus for controlling the air volume to the refrigerating compartment 16. Individual dampers 52,53 control the flow of cool air from the heat-exchanging compartment H into respective chambers 21,23, and thus control the air volume to each chamber 21,23.

Further, the kimchi chamber 23 is located at the right side of the individual compartment 20 (FIG. 3), disposed between the refrigerating compartment 16 and the freezing compartment 15. Provided on the rear wall of the chilled chamber 21 is the kimchi damper 52 for controlling the flow of cool air into the kimchi chamber 23.

Also provided on the right wall of the kimchi chamber 23 is an air discharging opening 26 for discharging the circulating air from the kimchi chamber 23. A cool air passage 28 is further provided for guiding the air passing through the air discharging opening 26 into the first partition wall 40. Furthermore, on the respective external surfaces of the right, left and upper surfaces of the kimchi chamber 23, a heater 24 for fermenting the kimchi at a higher temperature is mounted.

FIG. 4 is a perspective sectional view of the first intermediate partition wall 40. A plurality of cool air openings 41 are formed at the front of the upper surface of the first partition wall 40 and used for discharging the cool air from the refrigerating compartment 16. The openings 41 are extended toward the rear portion of the first partition wall 40 to form a common passage 42. The common passage 42 is connected to the cool air passage 28. Thus, the cool air passage 28 receives air discharging from both the kimchi chamber and the refrigerating compartment 26. Further, the lower portion of the cool air passage 28 is connected to a duct 80 which is formed in the rear wall 15W of the freezing compartment 15, and guides the cool air from the cool air passage 28 into the vegetable compartment 32.

The operation of the refrigerator will now be explained with reference to the attached drawings.

Some of the cool air heat-exchanged in the evaporator 17 is moved by the fan 18 to the freezing compartment 15 through the discharging opening 54 formed in the rear wall 19. At the same time, the remaining cool air heat-exchanged by the evaporator 17 is moved to the main duct 50 by the fan 18. The cool air in the main duct 50 is directed to the main damper 51, and the individual dampers 52,53 for the cooling of the chilled chamber 21 and the kimchi chamber 23, dependent on the temperature condition of these chambers. The cool air that has passed the main damper 51 is discharged into the refrigerating compartment 16 through the discharging opening 57 formed in the rear wall 68 of the refrigerating compartment 16. The cool air circulated in the refrigerating compartment 16 then flows through the cool air conducting passage 42 via the air return opening 41 of the first intermediate partition 40. The cool air in the conducting passage 42 is then directed through the cool air passage opening 28 as shown in FIG. 1.

The cool air that passes the damper 52 for the kimchi chamber 23 circulates in the kimchi chamber 23, and then the circulated air is induced into the kimchi chamber air discharging opening 26 formed on the right wall of the kimchi chamber 23 (FIG. 3). The cool air passing through opening 26 flows into the duct 80 (FIG. 2) via the portion of the cool air passage 28 formed on the right wall of the kimchi chamber 23 as shown in FIG. 4. The air flows circulated from the kimchi chamber 23 and the refrigerating compartment 16 are combined in the common passage 28 to become of uniform temperate and is directed to the vegetable compartment 32 via the duct 80.

The cool air that passes the damper 51 and enters the refrigerating compartment 16 is circulated in the refrigerating compartment 16, and this circulated air then enters the air return openings 41 formed on the upper front surface of the first partition wall 40 (FIG. 3). The cool air passes through the openings 26 and flows along the common passage 42 (FIG. 4) to the cool air passage opening 28.

The air from the air discharging opening 26 in the kimchi chamber 23, and the air from the air return opening 41 in the refrigerating compartment 16, are combined in the cool air passage 28. In this case, the air received from the kimchi chamber 23 ranges widely in temperature from high to low. That is, when in the fermenting cycle of the kimchi, the air temperature of the kimchi chamber rises to 30 degrees, while in the storage or the cooling cycle the air temperature holds at 3 degrees.

The relatively warmer air from the kimchi chamber is combined with the relatively cooler air from the refrigerating compartment by the air flow passage formed above. Thus, the air introduced into the vegetable compartment, is of lower temperature than the air discharged from the kimchi compartment thereby preserving vegetables for a long period of time.

What is claimed:

1. A refrigerator comprising:

an evaporator for cooling air;

a refrigerating compartment;

a freezing compartment;

a vegetable compartment;

a kimchi chamber including a heater for heating air in said kimchi chamber; and an air passage system interconnecting said refrigerating compartment and said kimchi chamber for combining first and second discharged air flows from said refrigerating compartment and said kimchi chamber, respectively, and directing the combined first and second air flows to said vegetable compartment.

2. The refrigerator according to claim 1, wherein said refrigerating and freezing compartments are vertically spaced apart by a horizontal divider wall, said divider wall forming a portion of said air flow passage system in which said first and second air flows.

3. The refrigerator according to claim 2, wherein said kimchi chamber is disposed atop said divider wall.

4. The refrigerator according to claim 3, wherein said refrigerating compartment is disposed above said freezing compartment.

5. The refrigerator according to claim 4, wherein said evaporator is disposed above said freezing compartment.

6. The refrigerator according to claim 1, wherein said evaporator is disposed in a rear wall of said freezing compartment.

* * * * *